US006852134B2

(12) United States Patent
Baumann et al.

(10) Patent No.: US 6,852,134 B2
(45) Date of Patent: Feb. 8, 2005

(54) METHOD OF IMPARTING STAIN RESISTANCE TO A DIFFERENTIALLY DYEABLE TEXTILE SURFACE AND THE ARTICLE PRODUCED THEREBY

(75) Inventors: Markus Baumann, Wiesloch (DE); Rainer Heinz, Oestringen (DE); Klaus Stark, Oestringen (DE)

(73) Assignee: Invista North America S.A.R.L., Wilmington, DE (US)

( * ) Notice: Subject to any disclaimer, the term of this patent is extended or adjusted under 35 U.S.C. 154(b) by 132 days.

(21) Appl. No.: 10/038,035

(22) Filed: Jan. 2, 2002

(65) Prior Publication Data

US 2002/0148049 A1 Oct. 17, 2002

Related U.S. Application Data

(63) Continuation-in-part of application No. PCT/US00/18589, filed on Jul. 7, 2000.

(51) Int. Cl.[7] ..... A47G 27/02; D06P 3/874; D06P 5/08

(52) U.S. Cl. ..... 8/485; 8/495; 8/531; 8/539; 8/151; 427/393.4; 427/430.1; 427/322

(58) Field of Search ..... 8/485, 495, 151, 8/531–539; 427/393.4, 430.1, 322

(56) References Cited

U.S. PATENT DOCUMENTS

| | | | | |
|---|---|---|---|---|
| 4,005,230 | A | | 1/1977 | Fleissner |
| 4,043,749 | A | * | 8/1977 | Huffman |
| 4,075,378 | A | * | 2/1978 | Anton et al. |
| 4,501,591 | A | | 2/1985 | Ucci et al. |
| 4,592,940 | A | | 6/1986 | Blyth et al. |
| 4,780,099 | A | | 10/1988 | Greschler et al. |
| 4,940,757 | A | | 7/1990 | Moss, III et al. |
| 5,131,918 | A | * | 7/1992 | Kelley |
| 5,135,774 | A | | 8/1992 | Calcaterra et al. |

(List continued on next page.)

FOREIGN PATENT DOCUMENTS

| | | |
|---|---|---|
| EP | 0 107 221 | 5/1984 |
| EP | 0 235 980 | 9/1987 |
| EP | 0 661 397 A2 | 7/1995 |
| EP | 735 181 | 2/1997 |
| WO | WO 89/02949 | 4/1989 |
| WO | WO 97/01665 | 1/1997 |

OTHER PUBLICATIONS

XP000160169, Stain–Resist Application Process Research Disclosure # 319 Nov 1990.
XP000168093, Stain Blockers for Nylon Fibers Rev. Prog. Coloration vol. 20 1990.

*Primary Examiner*—Margaret Einsmann

(57) ABSTRACT

A method of treating articles having a textile surface (such as broadloom carpets or carpet tiles) with a stainblocker composition is disclosed.

A pile surface structure having pile elements containing nylon yarns having both acid dyeability and cationic dyeability is dyed with both acid dye and cationic dye and then passed through a hot stainblocker treatment bath and a cooling zone. Substantially the entire height of each pile element is coated with a stainblocker composition whereby the pile surface structure has a stain resistance of 9 or higher on the AATCC Red 40 Stain Scale. The resulting pile surface has good color separation and stability, and no color loss from the catatonically dyeable yarns.

10 Claims, 3 Drawing Sheets

U.S. PATENT DOCUMENTS 5,229,483 A 7/1993 Fitzgerald
5,252,375 A 10/1993 Turbak et al.
5,447,755 A 9/1995 Pechhold et al.
5,460,891 A 10/1995 Buck et al.
5,549,963 A * 8/1996 Elgarhy et al.
5,681,620 A * 10/1997 Elgarhy
5,725,889 A * 3/1998 Buck
5,851,595 A 12/1998 Jones, Jr.
5,925,149 A * 7/1999 Pacifici et al.
6,387,448 B1 * 5/2002 Collier et al.

* cited by examiner

METHOD OF IMPARTING STAIN RESISTANCE TO A DIFFERENTIALLY DYEABLE TEXTILE SURFACE AND THE ARTICLE PRODUCED THEREBY

CROSS REFERENCE TO RELATED APPLICATION

This application is a continuing application based upon the priority of PCT/US 00/18589 designating the United States of America, filed Jul. 7, 2000, which is itself based upon the priority of EP Application 99 113 269.7, filed Jul. 8, 1999 (RD-7750 EPO).

BACKGROUND OF THE INVENTION

1. Field of the Invention

The invention relates to a continuous method for treating a textile surface made of differentially dyeable nylon yarns with a stainblocker composition to impart stain resistance thereto, and to the article produced thereby.

2. Description of the Prior Art

In the current floor covering market there is a perceived need for carpets made from differentially dyeable nylon yarns. By the term "differentially dyeable" it is meant that the article contains yarns having at least two different dyeabilities, such as acid dyeable yarn and cationic ("cat") dyeable yarn. Often a desired aesthetic effect in a carpet is possible only by combining yarns of these two different dyeabilities. Both dyeabilities are available in various dye depths, such as light, regular, deep and extra deep acid dye and light and regular cat dye.

In the current floor covering market there is a perceived need for carpets made from for a differentially dyeable carpet to exhibit a high degree of stain resistance. Compositions referred to as "stainblockers" are commonly applied to non-differentially dyeable carpets or carpet tiles to impart stain resistance. There is presently available both a continuous process and a discontinuous, or batch-wise, process for applying a stainblocker composition to a carpet made of non-differentially dyeable yarns.

Continuous Conventional Process. The steps of a conventional process for applying a stainblocker composition to a textile surface made of non-differentially dyeable yarns are listed along the left hand side in FIG. 3. In the conventional continuous process a running line of colored carpet (colored as by dyeing or printing), after rinsing and suction hydroextraction, is passed through an aqueous liquid treatment bath containing a stainblocker composition and a surfactant. The temperature of the bath is in the range from twenty to sixty degrees Celcius (20 to 60° C.). The residence time of the carpet in the bath is usually not adjusted as an independent critical parameter but is instead a function of the speed of the carpet line. After removal from the bath the carpet passes through a steam chamber wherein it is exposed to saturated steam for about sixty to ninety (60 to 90) seconds. Thereafter, conventional finishing steps for the carpet typically include: a suction hydroextraction operation where residual liquid is vacuumed from the carpet; a cold water rinse operation (either by spraying or passing the carpet through a dip trough); another suction hydroextraction operation; and a final drying.

Batch-wise Conventional Process. The batch-wise process for applying the stainblocker composition and a surfactant to a textile surface made of non-differentially dyeable yarns (such as a broadloom carpet) is termed the "winch/beck" process. In the batch-wise winch/beck process discrete dyed carpets are immersed in a vat a stainblocker composition and a surfactant. The temperature of the bath in the batch-wise winch/beck process is slightly higher than in the continuous process, in the range from seventy to seventy-five degrees Celcius (70 to 75° C.), and the residence time in the bath is on the order of twenty minutes. After removal from the bath, the carpet is subjected to the conventional finishing steps such as rinsing with cold water in situ, or after unloading from the hot application bath, rinsed by spray bar followed by a vacuum extraction operation to ensure no residual stainblocker is left.

In both the continuous process and the batch-wise process the stainblocker composition is preferably of the anionic functionalized type, and more preferably, of the sulphone resole type having nonionic functionality. It should be noted that in FIG. 3 the anionic functionalized type stainblocker compositions are referred to as "Stainblocker A", while the sulphone resole type stainblocker compositions are referred to as "Stainblocker B".

Tile Production To produce carpet tiles treated with a stainblocker composition it is common practice first to treat a broadloom carpet with a stainblocker composition in one of the manners specified, and after a backing is applied, to cut the broadloom carpet into pieces of the desired size to form carpet tiles.

Stainblockers Suitable anionic functionalized type stainblocker compositions include sulphonated phenol formaldehyde condensate types, maleic acid anhydride types, acrylate dispersions and mixtures thereof. Anionic functionalized type stainblocker compositions should be present between three weight percent (3 wt %) and five weight percent (5 wt. %) based on the weight of the nylon carpet fiber. When anionic functionalized type stainblocker compositions are used, the pH of the bath must be adjusted to between 2 and 5.

Examples of commercially available anionic functionalized type stainblocker compositions are available from E. I. Du Pont de Nemours and Company, Wilmington, Del., under the trademarks SR 300, SR 400 and SR 500; from Du Pont de Nemours International S. A., Geneva, Switzerland, under the trademark NRD 334; from Allied Colloids, Bradford/West Yorkshire, U.K., under the trademark Alguard RD; and from Bayer AG, Leverkusen, Germany, under the trademark Baygard DT.

When sulphone resole type stainblocker compositions with nonionic functionality are used, they should be present at between four weight percent (4 wt. %) and six weight percent (6 wt. %) based on the weight of the nylon carpet fiber, and the pH must be adjusted to between 6 and 7.5. An example of a commercially available sulphone resole type stainblocker composition with nonionic functionality is available from E. I. Du Pont de Nemours and Company, Wilmington, Del. under the trademark Zelan 8236.

The pH of the treatment bath may be adjusted by known acid donor additives such as acetic acid, citric acid and sulfamic acid.

Surfactants A surfactant may be added to the stainblocker bath separately or may be included as part of the stainblocker composition. The surfactant may be anionic, amphoteric or nonionic in nature. Preferably, the surfactant used will be either an alkylated diphenyl oxide disulfonate sodium salt, alone or in combination with an alkylnaphtalene sulfonic acid formaldehyde condensate sodium salt. The surfactant is generally added to the bath at a rate of between one (1) and four (4) grams per liter. Suitable surfactants are available from E. I. Du Pont de Nemours and Company, Wilmington, Del. under the trademark Zelan 50; from Dow Chemical Company, Midland, Mich., under the trademark Dowfax 3B2; or from BASF AG, Ludwigshafen, Germany, under the trademark Primasol NF.

Problem With Conventional Methods for Differentially Dyeable Textile Surfaces. Unfortunately, when either the continuous process or the batch-wise process is used to apply a stainblocker composition to a broadloom carpet containing differentially dyeable yarns the cationic dyestuff "bleeds" from the cat dyeable yarn into the surrounding stainblocker treatment bath, resulting in an unacceptable visual color change.

Low Liquor Method. The only publicly known system to apply a stainblocker composition to a differentially dyeable carpet is a method known as the "low liquor" method. Using the "low liquor" method a differentially dyeable carpet may attain at least a modest degree of stain resistance. In the "low liquor" method a cold-foamed liquor including a stainblocker composition and a fluorocarbon material are co-applied topically to the carpet. Thereafter the carpet is dried, without steam or water rinse. In the past, the stainblocker composition typically utilized was the acrylate dispersion sold by 3M Corporation under the trademark "FX-661", while the fluorocarbon material typically utilized was those sold by 3M Corporation under the trademarks "FC-3611", "FC-3602" or "FC-1395". However, the low liquor method is useful only with a carpet having a very low "wet pick-up", on the order of fifteen to twenty percent (15–20%). Wet pick-up (wpu) is the ratio of the weight of the liquid picked-up by the carpet from a treatment bath to the weight of the carpet. Moreover, with the low liquor method, the stainblocker composition penetrates into only about the upper twenty-five percent (25%) of the height of the pile elements of a differentially dyeable carpet. This depth of stainblocker penetration is not believed to be sufficient to impart a high degree of stain resistance.

Accordingly, in view of the foregoing, it is believed advantageous to provide a process for treating an article having a textile surface containing differentially dyeable nylon yarns, such as a broadloom carpet or carpet tiles, to impart a high degree of stain resistance thereto, while maintaining good color stability.

SUMMARY OF THE INVENTION

In one aspect the present invention is directed to a continuous method for treating an article having a textile surface made of differentially dyeable nylon yarns with a stainblocker composition to impart stain resistance thereto. This method (the "hot shock" method) comprises the sequential steps of:

(a) dyeing the textile surface of the article with an acid dyestuff and a cationic dyestuff;

(b) passing the textile surface of the article through a bath containing a stainblocker composition and a surfactant, the bath having a temperature in the range from seventy to ninety-five degrees Celsius (70 to 95° C.), the textile surface remaining in the bath for about five (5) to about thirty (30) seconds;

(c) removing excess water from the textile surface of the article;

(d) passing the article through an ambient temperature zone; and (e) rinsing the textile surface of the article with water, and thereafter suctioning and drying the same, such that substantially the entire textile surface of the article is coated with a stainblocker composition, whereby the textile surface has a stain resistance of 9 or higher on the AATCC Red 40 Stain Scale.

Preferably, the excess water is removed by passing the textile article through a pair of nip rolls to control the level of wet pick-up between two hundred and six hundred percent (200–600%). The textile article preferably remains in the cooling zone for twenty (20) to one hundred twenty (120) seconds.

In the instance where the article is a pile surface structure having a plurality of pile elements, substantially the entire height of each pile element is coated with the stainblocker composition whereby the pile surface structure has a stain resistance of 9 or higher on the AATCC Red 40 Stain Scale.

In this method, if the stainblocker composition is of the sulphone resole type having nonionic functionality (as is preferred) the stainblocker composition is present between four percent (4%) and six percent (6%) based on the weight of the nylon yarns, and the pH of the stainblocker bath is between six (6) and seven and one-half (7.5). Alternatively, if the stainblocker composition is of the anionic functionalized type, such as that selected from the group consisting of sulphonated phenol formaldehyde condensate type, maleic acid anhydride type, acrylate dispersions and mixtures thereof, the stainblocker is present between three percent (3%) and five percent (5%) based on the weight of the nylon yarns; and the pH of the stainblocker bath is between two (2) and five (5).

—o—O—o—

In another aspect the invention is directed an article having a textile surface formed from at least two types of dyeable nylon yarns. At least one type of nylon yarn is dyeable by an acid dyestuff and at least one other type of nylon yarn is dyeable by a cationic dyestuff. In accordance with the present invention the textile surface of the article is coated with a stainblocker composition such that the textile surface has a stain resistance of 9 or higher on the AATCC Red 40 Stain Scale. In a preferred embodiment the article takes the form of a pile surface structure wherein the textile surface is defined by a plurality of upstanding pile elements formed from the two types of dyeable nylon yarns. Substantially the entire height of each pile element is coated with the stainblocker composition.

The dyeable nylon yarns may be bulked continuous filament yarns or staple spun yarns. The pile elements may be formed in such a way that each pile element includes both a nylon yarn dyeable by an acid dyestuff and a nylon yarn dyeable by a cationic dyestuff. Alternately, the pile elements may be formed such that at least some of the pile elements are formed from a nylon yarn dyeable by an acid dyestuff and at least others of the pile elements are formed from a nylon yarn dyeable by a cationic dyestuff.

BRIEF DESCRIPTION OF THE DRAWINGS

The invention will be more fully understood from the following detailed description thereof, taken in connection with the accompanying drawings, which form a part of this application and in which.

DETAILED DESCRIPTION OF THE INVENTION

Figure 1:
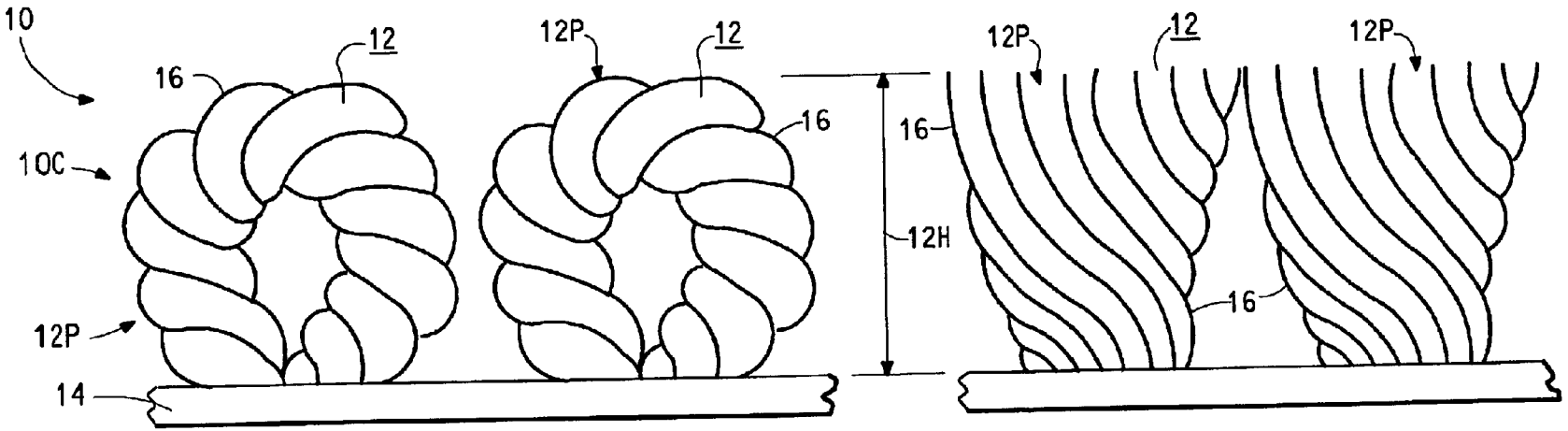
FIG. 1 is a side view of a pile surface structure in accordance with the present invention.

Throughout the following detailed description similar reference numerals refer to similar elements in all figures of the drawings.

The present invention is broadly directed to a method for applying a stainblocker composition to any article having a textile surface to impart stain resistance thereto and to articles produced thereby. The textile surface may be one that is formed from at least two types of dyeable_nylon yarns. At least one type of nylon yarn is dyeable by acid dyestuffs and at least one other type of nylon yarn is dyeable by cationic ("cat") dyestuffs. A textile surface that contains yarns having at least two different dyeabilities, such as cationic dyeable yarn and acid dyeable yarn, is termed "differentially dyeable".

In accordance with the present invention the textile surface of the article is coated with a stainblocker composition such that the textile surface has a stain resistance of 9 or higher on the AATCC Red 40 Stain Scale.

The most preferred form of an article 10 in accordance with the present invention is illustrated in FIG. 1. In FIG. 1 the article 10 is embodied by a carpet 10C whose textile surface 12 is defined by a plurality of upstanding pile elements 12P. The pile elements 12P extend above a backing 14. The carpet 10C may be a full broadloom size, or (once the backing is applied) may be cut into the form of "carpet tiles". As is appreciated by those in the art, "carpet tiles" are, in the typical case, generally square pieces of carpet having dimensions on the order of fifty-by-fifty centimeters (50×50 cm.). Of course, tiles may take other shapes and exhibit any desired range of sizes.

As the result of treatment of the carpet 10C (in either broadloom or tile form) with either embodiment to be described herein, substantially the entire height 12H of each pile element 12P has a coating 16 of a stainblocker composition thereon. It should be noted that although in practice the coating 16 of stainblocker composition would be invisible, for purposes of illustration the presence of the coating 16 is represented in FIG. 1 by relatively bold lines on the contours of the pile elements 12P.

Since the textile surface 12 of the carpet 10C illustrated in FIG. 1 is defined by the plurality of upstanding pile elements 12P, the carpet 10C is hereinafter be referred to as a "pile surface structure". This nomenclature serves to distinguish the illustrated pile surface structure 10C from alternative forms of carpet structures in which the textile surface is defined by a textile fabric. These alternative forms of carpet structures also lie within the contemplation of the invention. An example of one such alternative form of carpet structure is the carpet disclosed in International Publication WO 97/01665 (Vinod).

The pile elements 12P defining the textile surface of the pile surface structure 10C may be either cut pile (as illustrated in the right hand portion of FIG. 1) or loop pile (as illustrated in the left hand portion of FIG. 1). The pile elements 12P may be produced by any suitable known carpet forming process, such as tufting, weaving or knitting. In the case of a differentially dyeable pile surface structure, each pile element 12P, however produced, may be comprised entirely of either acid dyeable nylon yarns or cat dyeable nylon yarns. Alternately, each pile element 12P may comprise a combination of both acid dyeable nylon yarns or cat dyeable nylon yarns. The nylon material may be nylon 6,6 or nylon 6 or any of the various copolymers thereof. The yarn is either a bulked continuous filament yarn or a staple spun yarn.

The backing 14 for the pile surface structure 10C may be implemented using any convenient materials. A preferred backing construction is a synthetic latex/chalk filler compound.

—o—O—o—

Figure 2:
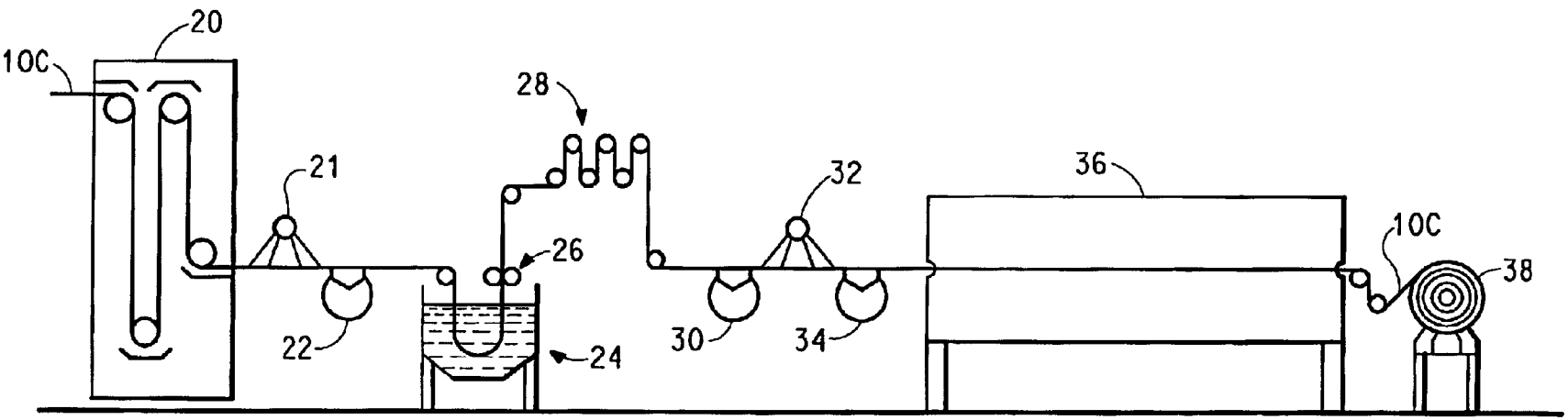
FIG. 2 is a schematic representation of the steps of a method for treating an article having a textile surface with a stainblocker in accordance with the present invention; and, FIG. 3 is a block diagram representation in which the steps of the "hot shock" process of the present invention shown schematically in FIG. 2 extend along the right hand side of FIG. 3, while the steps of a conventional method for applying a stainblocker composition to a textile surface made of non-differentially dyeable yarns extend along the left hand side of FIG. 3.
Figure 3:
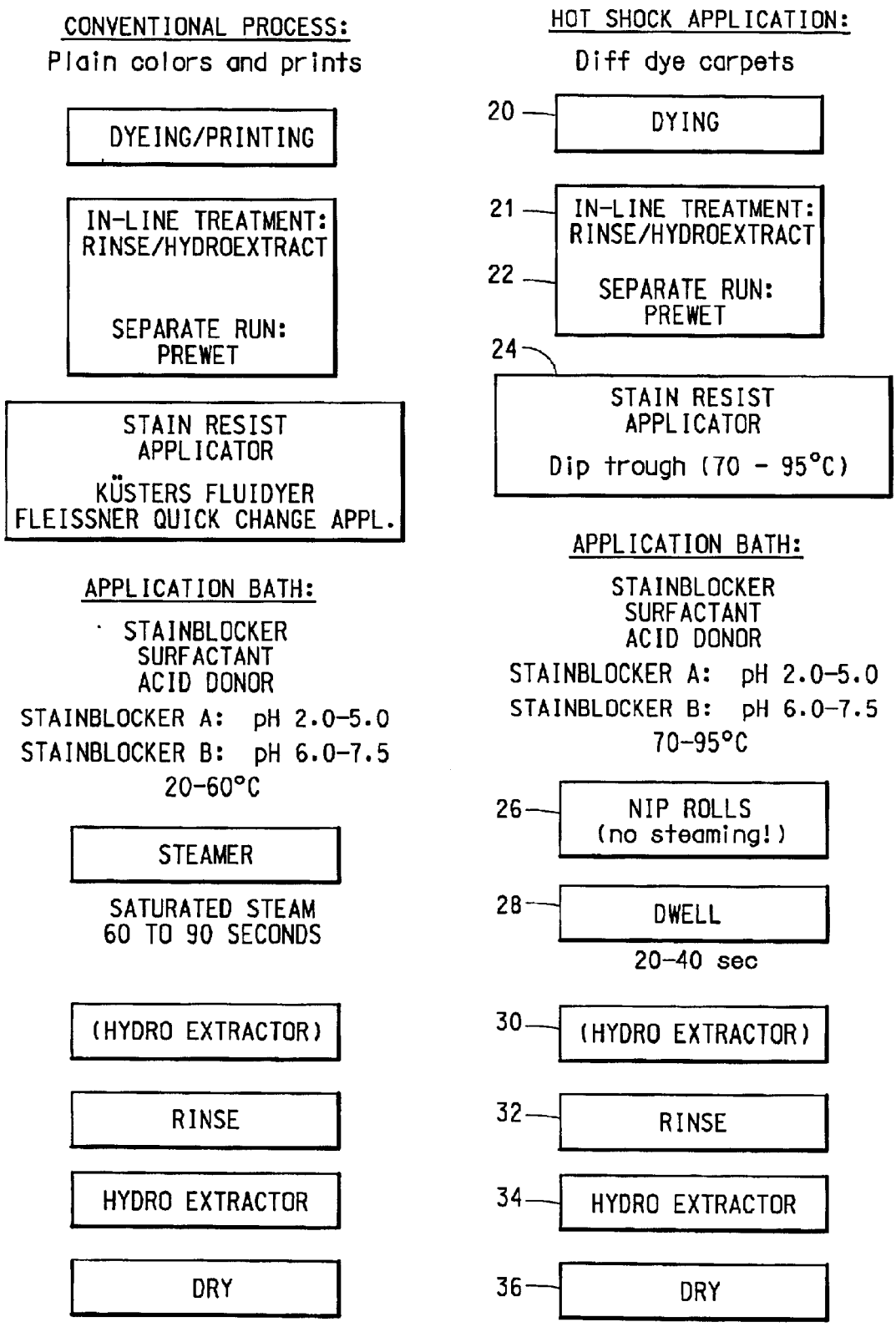

The "hot shock" process by which the pile surface structure 10C (or the textile surface of any article) is treated with a stainblocker composition will now be described in connection with the schematic representation of FIG. 2 and the corresponding block diagram representation of FIG. 3. This process of the present invention is implemented in a continuous, as opposed to batch-wise, manner.

After being made using any known carpet-forming process the undyed pile surface structure 10C is dyed in a dye bath 20 containing both cationic dyestuffs and acid dyestuffs. The cat dyeable nylon yarns and the acid dyeable nylon yarns that form the pile elements 12P are each colored by the appropriate dyestuff so that both types of yarns may contribute to the visual aesthetic properties of the pile surface structure 10C.

The process conditions for the dye bath 20 are suitable for the dyes chosen for use. Some commercially available acid dyes that may be suitable for use in the dye bath 20 include those sold by Ciba Specialty Chemicals, Inc., Basel, Switzerland, under the trademark Tectilon; by DyStar Textilfarben, Leverkusen, Germany under the trademark Telon; by Clariant (Switzerland) Ltd., Basel, Switzerland under the trademark Nylosan; and by Crompton & Knowles, Charlotte, N.C., under the trademark Nylanthren. Some commercially available cationic dyes that may be suitable for use in the dye bath 20 include those sold by Ciba Specialty Chemicals, Inc., Basel, Switzerland, under the trademark Maxilon; by DyStar Textilfarben, Leverkusen, Germany, under the trademark Astrazon; by Clariant (Switzerland) Ltd., Basel, Switzerland, under the trademark Sandocryl; and by Crompton & Knowles, Charlotte, N.C., under the trademark Sevron.

After dyeing, the pile surface structure 10C passes through a cold water rinsing step 21 and a hydroextraction step 22 to remove residual dyes and chemicals. Any conventional arrangement for suctioning liquid from a carpet may be used to perform the hydroextraction step. Both these steps are similar to corresponding steps of the continuous process of the prior art. If dyeing of the pile surface structure occurs at an earlier time, the pile surface structure must be prewet (as at the water rinsing step 21) and the water extracted (as at step 22) before the stainblocker is applied.

After hydroextraction the pile surface structure 10C passes through a hot aqueous liquid treatment bath 24 containing a stainblocker composition and a surfactant. Although the same stainblocker compositions and surfactants as are used in the conventional continuous process as earlier described are used in the treatment bath 24, it has been found that if the temperature of the treatment bath 24 and dwell time of the pile surface structure 10C therein are in accord with the teachings of the present invention bleeding of cationic dyestuff from the cat dyeable yarn does not occur.

In accordance with the present invention the temperature of the hot treatment bath 24 is in the range from about seventy to about ninety-five degrees Celsius (70 to 95° C.). More preferably, the temperature is in the range from about eighty to about eighty-five degrees Celsius (80 to 85° C.). The temperature of the hot bath 24 is maintained by direct or indirect heating with automatic control. A suitable system useful for the application step 24 is that manufactured under the name "hot shock applicator" by Eduard Kuesters Maschinenfabrik GmbH & Co. KG, Krefeld, Germany, comprising a low volume dip trough and a steam-supplied plate heat exchanger with electronic temperature control.

The pile surface structure 10C should remain in the bath 24 for a residence time in the range from about five (5) to about thirty (30) seconds, and more preferably, in the range from about five (5) to about ten (10) seconds.

As to the stainblocker compositions themselves, sulphone resole type stainblocker compositions with nonionic functionality (in the appropriate weight percentages and with appropriate pH adjustment) are preferred. The commercially available sulphone resole type stainblocker composition with nonionic functionality is available from E. I. Du Pont de Nemours and Company, Wilmington, Del. under the trademark Zelan 8236 is preferred.

Anionic functionalized type stainblocker compositions (also in the appropriate weight percentages and with appropriate pH adjustment) may also be used. As earlier discussed the pH of the treatment bath may be adjusted by known acid donor additives such as acetic acid, citric acid and sulfamic acid. Preferred surfactants again include appropriate amounts of an alkylated diphenyl oxide disulfonate sodium salt, alone or in combination with an alkylnaphtalene sulfonic acid formaldehyde condensate sodium salt. The surfactant available from E. I. Du Pont de Nemours and Company, Wilmington, Del. under the trademark Zelan 50 is preferred.

When the stainblocker composition is of the sulphone resole type having nonionic functionality the stainblocker composition is present between four percent (4%) and six percent (6%) based on the weight of the nylon yarns, and the pH of the stainblocker bath is between six (6) and seven and one-half (7.5). In commercial mill applications, where the above temperature conditions for the stainblocker bath may be held, stainblocker compositions between one and one-half percent (1.5%) and two percent (2%) based on the weight of the nylon yarns, with a pH of the stainblocker bath is between 6.3 and 6.5 may be used.

After exiting the hot treatment bath 24 excess water is removed from the pile surface structure 10C. To this end the pile surface structure 10C passes through a pair of nip rolls 26. Preferably, the rolls 26 adjust the wet pick-up of the pile surface structure 10C to between two hundred percent (200%) and six hundred percent (600%) and more preferably, to about three hundred percent (300%). The pressure between the nip rolls 26 may be varied in order to find the optimal wet pick-up for a given carpet construction and process. Expedients other than nip rolls may be used to remove the excess moisture.

Thereafter, the pile surface structure 10C passes through an ambient temperature zone 28 in which the pile surface structure 10C cools toward the ambient air temperature. Preferably, the pile surface structure 10C remains in the cooling zone 28 for between twenty (20) to one hundred twenty (120) seconds, and more preferably, between twenty (20) to forty (40) seconds. It should be noted that in accordance with this invention the pile surface structure 10C is not subjected to a steaming step, as in the prior art continuous process.

After undergoing treatment in the hot bath 24 and cooling in the air cooling zone the pile surface structure 10C is subjected to the conventional finishing steps normally used in the continuous immersion process of the prior art. Such finishing steps would include a suction operation 30, a cold water rinse operation 32, and another suction operation 34. Finally, the pile surface structure 10C is dried in an oven 36 and collected by a take-up roll 38.

EXAMPLES 1–3

Test Methods. The following test methods were used in the Examples 1–3 below to measure carpet samples made according to the "hot shock" embodiment of the invention as well as control samples for stain resistance, color stability and dyelightfastness.

Kool-Aid® Soft Drink Stain Resistance Standard Test (Standardized AATCC Test Method 175-1991: Red 40 Stain Rating Scale). This impact tester method simulates a "household accident" with a spill dropped from table height onto a carpet.

Staining Agent: The staining agent is a ninety (90) gram per thousand (1000) cc water solution of cherry-flavored, sugar-sweetened Kool-Aid® soft drink. The solution is permitted to reach room temperature (22±2° C.) before use. An alternative staining agent is a solution containing 0.1 gram/liter FD&C Food Red 40 dyestuff, one (1) gram/liter citric acid, and ten (10) gram/liter sugar.

Equipment: A specially designed impact tester is used to apply the staining agent to the specimens under test. The impact tester comprises a cylinder (of plastic or glass) that is 28 cm high with a 6.5 cm inside diameter. A massive piston nine (9) cm in length weighing four hundred (400) grams is received on the inside of the cylinder. The piston is made from a plastic material (PVC or PTFE). The piston is vertically movable within the cylinder by a bolt fitted to the piston. The bolt projects through a four (4) mm vertical slot in the cylinder. A small (seven (7) mm diameter) hole is drilled through the cylinder two cm from the bottom for injecting staining agent.

Procedure: Test samples, measuring ten (10) cm square, are cut from each pile surface structure under test. The impact tester is centered on each sample and the plastic piston lifted and fixed in position by the bolt in the slot. Using a syringe twenty (20) cc of the staining agent is injected through the small hole over the surface of the sample. The plastic piston is released and drops freely onto the carpet sample. The impact corresponds to the impact of a cup of liquid falling from the table height [eighty (80) cm]. The impact tester is removed and the sample is left, undisturbed, in a horizontal position for twenty-four (24±4) hours. Without damaging the pile, the sample is rinsed thoroughly with tap water at about twenty degrees Celsius (20° C.), centrifuged to remove any excess water and dried in a forced air oven at maximum of seventy-five degrees Celsius (75° C.).

Each sample is evaluated for staining, using the AATCC Red 40 Stain Scale. According to this scale stains are rated on a scale of 1 to 10, with "1" designating heavy staining and "10" designating no staining. A sample receiving a rating of "9" is considered to have acceptable stain resistance.

Coffee Stain Resistance Standard Test This test is substantially identical to the Kool-Aid® soft drink test, except that the staining agent is a twenty gram per liter (20 g/l) solution of an instant coffee (e.g. Nescafe® Gold coffee, with no additives such as milk, cream or sugar) at a temperature of sixty degrees Celsius (60° C.).

Color Measurement Color measurements were made using the international standard color measurement method promulgated by "Commission Internationale de L'Eclairage" (Paris, France), (International Society for Illumination/Lighting), ("CIE") using standard color coordinates of both the CIELAB L*a*b* and the CIELAB L*C*h color space: "L" designates the lightness coordinate; "a" designates the red/green coordinate (+a indicating red, −a indicating green); "b" designates the yellow/blue coordinate (+b indicating yellow, −b indicating blue); and "C" designates the chroma coordinate, the perpendicular distance from the lightness axis (more distance indicating more chroma).

Dyefastness Dyelightfastness is measured according to standardized test method DIN 54004 (ISO 105 B02). This method is based on scale of 1 to 8, according to standardized "bluescale" of eight different blue wool dyestuffs, dyed on a wool fabric, which are joint into the light exposure process together with the test specimen (1-very poor, 8-very high lightfastness).

EXAMPLES 1–3. The pile surface structure in Example 1 and Controls 1*a*–1*c* were a loop construction containing three different filament yarn types having regular cationic, light cationic and deep acid dyeabilities. The deep acid dyeable yarns were dyed green. The regular and light cationic dyeable yarns were dyed orange in two color steps.

Control 1*a* was treated by conventional batch-wise winch/beck process. Control 1*b* was treated by conventional continuous application. Control 1*c* is an untreated control carpet. Example 1 was treated by the method of the present invention. The temperature of bath was eighty-five degrees Celsius (85° C.), the residence time of the article in the bath was ten (10) seconds, and the time in the ambient temperature zone was thirty (30) seconds.

In Example 1 and Controls 1*a*–1*b* the stainblocker composition was ZELAN® 8236 (DuPont) and the surfactant used was ZELAN® 50 (DuPont). The stainblocker composition was applied at 5.5% of pile weight and pH values were adjusted with acetic acid. Control 1*a* was treated for twenty minutes at pH 6.8 and at a temperature of 75° C. Control 1*b* was treated at pH 6.8 and steamed afterwards. The wet pick-up was 400%. Example 1 was treated as described above at a pH of 6.8. Control 1*c* was not treated in order to compare color stability and dyelightfastness.

After treating with the stainblocker composition Example 1 and Controls 1*a*–1*b* were water rinsed, hydroextracted and dried. After dyeing, Example 1 and Controls 1*a*–1*b* were each tested for color stability and dyelightfastness by the test methods described above. The results are reported in Table 1.

As can be seen from Table 1 Example 1 shows smallest deviation in color saturation (C* values). Also, the dyelightfastness resulting from each application method was good.

TABLE 1

| No. | L* | a* | b* | C* | Dyelightfastness |
|---|---|---|---|---|---|
| Control 1a | 46.74 | −1.09 | +10.39 | 10.45 | 5–6 |
| Control 1b | 46.70 | −1.44 | +13.09 | 13.17 | 5–6 |
| Example 1 | 46.43 | −1.95 | +14.74 | 14.87 | 5–6 |
| Control 1c | 46.31 | −2.15 | +15.78 | 15.96 | 6 |

Example 2 and Controls 2*a*–2*c* The pile surface structure in Example 2 and Controls 2*a*–2*c* was a velour construction containing four different filament nylon yarn types having regular acid, extra deep acid, regular cationic and light cationic dyeabilities. The pile surface structure was dyed to grey and orange colors. The regular acid dyeable yarn was light gray, the extra deep acid dyeable yarn was dark gray, the regular cationic dyeable yarn was dark orange, and the light cationic dyeable yarn was light orange. Example 2 and Controls 2*a*–2*c* were performed exactly as Example 1 and Controls 1*a*–1*c*. After dyeing, the carpet sample pieces were each tested for stain resistance using both the Kool-Aid® soft drink stain resistance test and the coffee stain resistance test. The results are reported in Table 2. The results show little difference between the samples, also the stain resist properties of Example 2 are the best overall.

Due to the special fine four component color pattern in this carpet, a color measurement could not be done, the samples were only visually compared.

TABLE 2

| | Kool-Aid | Coffee |
|---|---|---|
| Control 2a | 10 | 9–10 |
| Control 2b | 10 | 9 |
| Example 2 | 10 | 10 |
| Control 2c | 1 | 1 |

Example 3 and Controls 3*a*–3*c* These examples demonstrated the application of stainblocker compositions on cationic dyeable nylon carpets. Example 3 and Controls 3*a*–3*c* were performed exactly as Example 1 and Controls 1*a*–1*c*. In Example 3 and Controls 3*a*–3*c* the pile surface structure was a velour construction of one hundred percent cationic dyeable nylon yarn. The carpet was orange in color. The samples were each tested for color stability and dyelightfastness by the test methods described above. The results are reported in Table 3. These results demonstrate the small deviation in color saturation of the hot-shock treated carpet sample piece (compare Controls 3*a*, 3*b* and Example 3 to Control 3*c*). Also these results showed improved dyelightfastness of hot shock treated carpet sample piece Example 3c compared to Examples 3a and 3b.

TABLE 3

| No. | L* | a* | b* | C* | Dyelightfastness |
|---|---|---|---|---|---|
| Control 3a | 61.97 | +34.56 | +39.75 | 52.67 | 4–5 |
| Control 3b | 58.96 | +37.78 | +47.88 | 60.99 | 4–5 |
| Example 3 | 58.01 | +39.75 | +48.86 | 62.99 | 5–6 |
| Control 3c | 57.79 | +40.07 | +49.78 | 63.90 | 5–6 |

Discussion of Results Example 1 and Example 3 showed the smallest measured color deviation from the untreated control samples. Also in Example 2, where only a visual rating was feasible, the sample treated according to the above-described method showed the smallest color change from the control color. In all three examples application of the stainblocker composition using a bath having a temperature and with dwell times in accordance with the present invention resulted in the lowest and still acceptable color change on the cationic dyeable yarn components. This is believed to be the first industry applicable method to treat nylon differential dye carpets with stainblocker chemicals without unacceptable color loss on the cationic dyeable yarn. In all cases good stainblocking results were received. The dyelightfastness results were even one-half (½) to one (1) note better than after standard application methods.

What is claimed is:

1. A method for treating an article having a textile surface with a stainblocker composition, the textile surface being formed from at least two types of dyeable nylon yarns, wherein at least one type of nylon yarn is dyeable by an acid dyestuff and at least one other type of nylon yarn is dyeable by a cationic dyestuff, the method comprising the sequential steps of:

(a) dyeing the textile surface of the article with an acid dyestuff and a cationic dyestuff;

(b) passing the textile surface of the article through a bath containing a stainblocker composition and a surfactant, the bath having a temperature from above seventy to ninety-five degrees Celsius (70 to 95° C.), the textile surface remaining in the bath for about five (5) to about thirty (30) seconds;

(c) removing excess water from the textile surface of the article;

(d) passing the article through an ambient temperature zone; and (e) rinsing the textile surface of the article with water, and thereafter suctioning and drying the same, such that substantially the entire textile surface of the article is coated with a stainblocker composition whereby the textile surface has a stain resistance of 9 or higher on the AATCC Red 40 Stain Scale.

2. The method of claim 1 wherein the textile article is a pile surface structure having a plurality of pile elements thereon, the pile elements being formed from the first and the second types of nylon yarn, wherein substantially the entire height of each pile element is coated with a stainblocker composition whereby the pile surface structure has a stain resistance of 9 or higher on the AATCC Stain Rating Scale 40.

3. The method of 1 wherein the stainblocker composition is of the anionic functionalized type.

4. The method of claims 3 wherein the stainblocker composition is selected from the group consisting of sulphonated phenol formaldehyde condensate type, maleic acid anhydride type, acrylate dispersions and mixtures thereof; the stainblocker is present between three percent (3%) and five percent (5%) based on the weight of the nylon yarns; and the pH of the stainblocker bath is between two (2) and five (5).

5. The method of claims 1 wherein the stainblocker composition is of the sulphone resole type having nonionic functionality.

6. The method of claim 5 wherein the stainblocker composition is present between one and four percent (4%) and six percent (6%) based on the weight of the nylon yarns, and the pH of the stainblocker bath is between six (6) and seven and one-half (7.5).

7. The method of claim 1 wherein the two types of dyeable nylon yarns are bulked continuous filament yarns.

8. The method of claims 1 wherein the two types of dyeable nylon yarns are staple spun yarns.

9. The method of claim 2 wherein at least some of the pile elements are formed from both a nylon yarn dyeable by an acid dyestuff and a nylon yarn dyeable by a cationic dyestuff.

10. The method of claim 2 wherein at least some of the pile elements are formed from a nylon yarn dyeable by an acid dyestuff and at least others of the pile elements are formed from a nylon yarn dyeable by a cationic dyestuff.

* * * * *